United States Patent [19]

Namba et al.

[11] 4,289,263

[45] Sep. 15, 1981

[54] APPARATUS FOR FEEDING A STRIP OF CONTINUOUS FORMS

[75] Inventors: Takamasa Namba; Hidekata Yanagawa, both of Tokyo; Nobuo Fujimoto, Seto; Takehiko Mori; Takayoshi Yamada, both of Owariasahi, all of Japan

[73] Assignees: Hitachi, Ltd.; Japan Air Lines Company Limited, both of Tokyo, Japan

[21] Appl. No.: 84,454

[22] Filed: Oct. 12, 1979

[30] Foreign Application Priority Data

Oct. 25, 1978 [JP] Japan ..... 53/130525

[51] Int. Cl.[3] ..... B65H 23/04; G03B 1/48

[52] U.S. Cl. ..... 226/196; 493/417

[58] Field of Search ..... 226/196, 200; 270/52.5, 270/61 F, 67, 80, 44, 48, 51; 93/8, 36, 61, 49 M, 49 R

[56] References Cited

U.S. PATENT DOCUMENTS

| | | | |
|---|---|---|---|
| 3,579,947 | 5/1971 | Kalman | 270/51 X |
| 3,745,892 | 7/1973 | Ganz | 93/49 M |
| 3,804,399 | 4/1974 | Rupp | 270/67 X |
| 3,901,501 | 8/1975 | Kistner | 270/62 |
| 3,985,351 | 10/1976 | Fortenberry | 270/80 X |

*Primary Examiner*—Leonard D. Christian

*Attorney, Agent, or Firm*—Craig and Antonelli

[57] ABSTRACT

In feeding a strip of continuous forms including forms arranged in a plurality of layers and having a plurality of series of perforations extending widthwise of the strip and arranged at regular intervals lengthwise of the strip, the strip is bent at one of the series of perforations to provide a bent portion, and a member is located inwardly of the bent portion of the strip for movement toward and away from the bent portion of the strip. When the member is brought into contact with the bent portion of the strip, the upper and lower layers of the strip are brought into alignment with one another through the series of perforations.

5 Claims, 6 Drawing Figures

APPARATUS FOR FEEDING A STRIP OF CONTINUOUS FORMS

BACKGROUND OF THE INVENTION

1. Field of the Invention

This invention relates to an apparatus for feeding a strip of continuous forms used with a printer, for example, and more particularly it is concerned with a form aligning device of the apparatus for feeding the strip of continuous forms composed of a plurality of forms or parts arranged in superposed relation.

2. Description of the Prior Art

In one type of apparatus for feeding a strip of continuous forms used as with a printer composed of a plurality of forms or parts arranged in superposed relations in a plurality of layers, it has hitherto been usual practice to form feeding apertures or what are generally referred to as sprocket apertures at regular intervals in opposite marginal portions of upper and lower forms and to adhesively connect the upper and lower forms at their sides as by pasting to avoid displacements of the upper and lower forms relative to one another. The strip of continuous forms has formed therein with a plurality of series of perforations extending widthwise of the strip and spaced apart from one another by a predetermined distance in the direction of feed of the strip for folding the strip in a plurality of portions stacked in a pile. It is generally known that in the apparatus for feeding a strip of continuous forms described hereinabove, the strip of continuous forms of the aforesaid construction is used and fed by means of sprocket wheels by utilizing the sprocket apertures to avoid displacements of the upper and lower forms relative to one another when the strip of continuous forms is fed.

Some disadvantages are associated with the apparatus of the prior art described hereinabove. For example, when the forms are separated one from another and put to use after printing is effected thereon, the problem of the forms being broken or irreparably damaged at the portions thereof at which the forms are connected together as by pasting has arisen. Also, when the forms are air-line tickets, for example, each ticket assembly is severed from the strip at the perforations and printed for use. In this case, the presence of the sprocket apertures seriously interferes with the smooth operation of an optical read-out device in view of the lower form feeding capacity of such device when the uppermost tickets of the assemblies are subjected to read-out by the optical read-out device for the purpose of finding out the total of the sold tickets or making fare adjustments. Thus the use of paste for connecting the upper and lower layers of forms together and the formation of sprocket perforations in the strip of continuous forms that have hitherto been made necessary in feeding the strip of continuous forms by the apparatus of the prior art described hereinabove have created serious problems with regard to the handling of individual forms.

SUMMARY OF THE INVENTION

This invention obviates the aforesaid disadvantages of the prior art. Accordingly, the invention has as its object the provision of an apparatus for feeding continuous forms provided with a form aligning device which enables the forms arranged in superposed relation one over another in the strip to be properly positioned relative to one another with no displacements occurring between the upper and lower forms even if the forms are not pasted together.

To accomplish the aforesaid object, according to the present invention, there is provided apparatus for feeding continuous forms which comprises a form aligning device suitable for use with a strip of continuous forms composed of two or more layers of continuous forms and formed with a plurality of series of perforations extending widthwise thereof, such form aligning device comprising a member located beneath and positioned against the inner surface of one of bent portions formed by bending the strip at one series of perforations, such member being operative to move upwardly into engagement with the inner surface of the bent portion so as to thereby align the upper and lower forms through the series of perforations by eliminating displacements of the upper and lower forms when such strip of continuous forms is fed during operation.

By virtue of the form aligning device constructed as aforesaid according to the invention, a strip of continuous forms can be fed without displacements of the upper and lower forms relative to one another occurring even if they are not pasted together.

Elimination of the need to paste the upper and lower forms together at the sides thereof makes it possible to dispense with form strip feeding device of the sprocket wheel type. Also, handling of the strip of continuous forms is facilitated, and the problem of the forms being broken when separated from one another does not arise.

DESCRIPTION OF THE PREFERRED EMBODIMENTS

Figure 1:
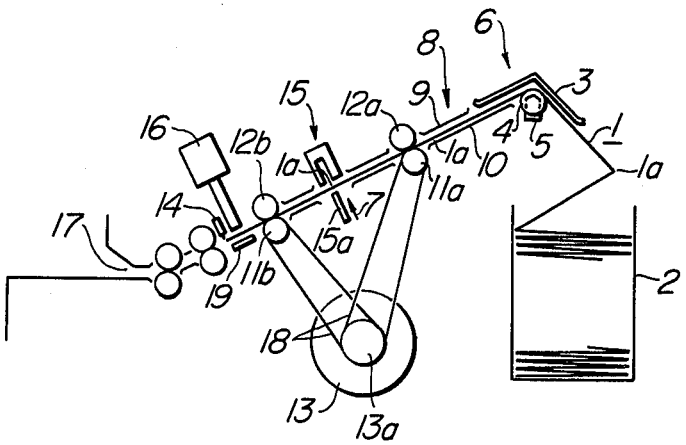
FIG. 1 is a schematic view of the apparatus for feeding a strip of continuous forms comprising one embodiment of the present invention.
Figure 2:
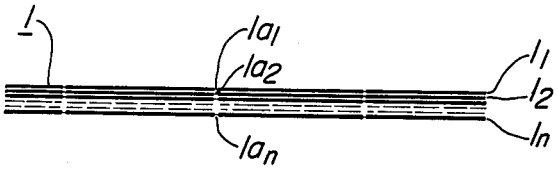
FIG. 2 is a fragmentary schematic side view of a strip of continuous forms used with the apparatus for feeding a strip of continuous forms according to the invention.
Figure 3:
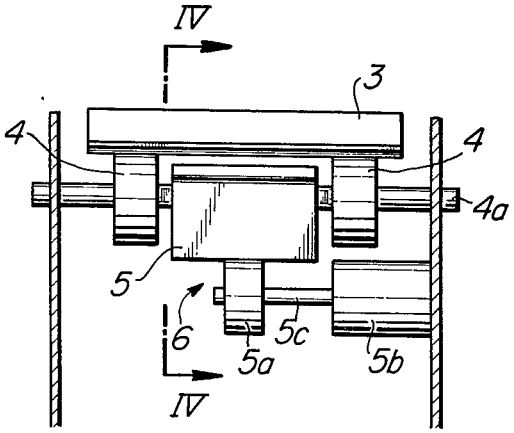
FIG. 3 is a schematic view of the essential portions of the form aligning device constituting the essentials of the present invention.
Figure 4:
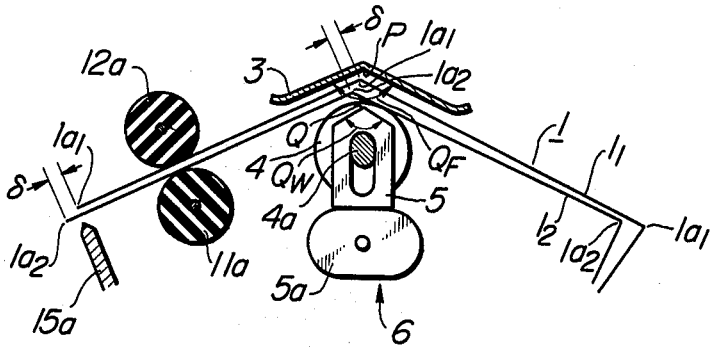
FIG. 4 is a sectional view taken along the line IV—IV in FIG. 3, showing a strip of continuous forms before displacements of the upper and lower forms relative to one another are corrected.
Figure 5:
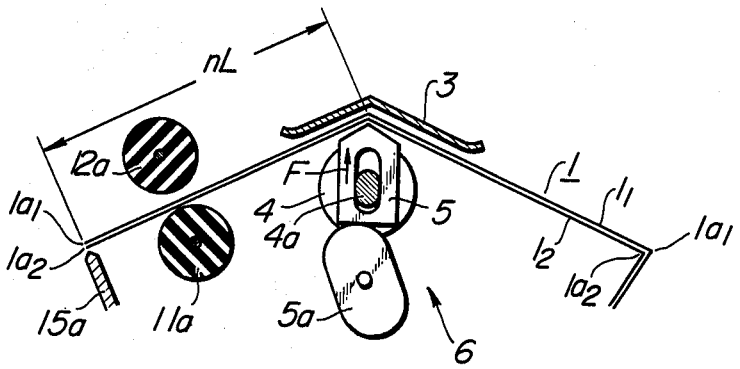
FIG. 5 is a view similar to FIG. 4 but showing the strip of continuous forms after displacements of the upper and lower forms relative to one another are corrected.

FIG. 1 is a schematic view of the apparatus for feeding a strip of continuous forms embodying the present invention, and FIG. 2 shows the essential portions of a strip of continuous forms. FIGS. 3 to 5 are views in explanation of the operation of the form aligning device according to the invention.

In FIG. 1, a strip 1 of continuous forms superposed one over another in a plurality of layers is folded at a plurality of series of perforations 1*a* extending widthwise of the strip 1 and spaced apart from one another by a predetermined distance lengthwise thereof, and contained in a form container 2. As shown in FIG. 2, the strip 2 is composed of a plurality of layers of forms $\mathbf{1}_1$, $\mathbf{1}_2 \ldots \mathbf{1}_n$ superposed one over another and formed with a plurality of series of perforations $\mathbf{1}_{a1}$, $\mathbf{1}_{a2}$, . . . $\mathbf{1}_{an}$ located in the same positions and spaced apart from one another the same distance. The strip 1 is supplied from the form container 2 and fed to a transporting device 8 through a form aligning device 6 comprising a form aligner guide 3, guide rollers 4 and a form aligner wedge 5.

The transporting device 8 comprises an upper guide 9, a lower guide 10, drive rollers 11*a* and 11*b*, pinch rollers 12*a* and 12*b* and a drive assembly for driving the drive rollers 11*a* and 11*b* including drive belts 18, a clutch 13*a* and a motor 13. The transporting device 8 is provided with a photoelectric sensor 14 located downstream of a printer 16 for detecting the leading edge of the strip 1. The transporting device 8 is constructed such that the drive rollers 11*a* and 11*b* can be driven independently of each other by means of the clutch 13*a*.

The pinch rollers 12*a* and 12*b* are movable toward and away from the drive rollers 11*a* and 11*b*, respectively by another mechanism, not shown, and press against the strip 1 when they are abutted against their respective drive rollers. The drive rollers 11*a* and 11*b* cooperate with the pinch rollers 12*a* and 12*b* respectively for transporting the strip 1 until the leading edge of the latter is brought to a position in which the photoelectric sensor 14 is located downstream of the printer 16 after passing through cutter assembly 15.

Upon the leading edge of the strip 1 being detected by the photoelectric sensor 14, the clutch 13*a* is released and the strip 1 is brought to a halt in a position shown in FIG. 1. The position in which the strips 1 comes to a halt is controlled in such a manner that the series of perforations 1*a* is indexed with the cutter assembly 15 when the strip 1 is stationary. After becoming stationary, the strip 1 is cut at the series of perforation 1*a* by a cutter 15*a* as the latter moves in the direction of an arrow 7. The forms severed from the strip 1 are moved by the drive roller 11*b* and placed on a platen 19 of the printer in the usual manner, and printing is done on the forms 1 by the printer 16 in the known manner. After the printing is effected, the printed forms 1 are ejected through an ejection opening 17.

The form aligning device 6 is actuated to handle the strip 1 to correct any displacements of the upper and lower forms relative to one another while the forms 1 severed from the strip 1 at the series of perforations 1*a* are subjected to printing as aforesaid.

As shown in FIG. 1, the guide rollers 4 of the form aligning device 6 are located above and between the strip inlet of the transporting device 8 and the strip supply port of the strip container 2. By this arrangement, a bent portion can be formed in the strip 1 when the latter passes through the form aligning device 6.

The guide rollers 4 are located in a position which is spaced apart from the position of the photoelectric sensor 14 by a distance substantially corresponding to the spacing between the two series of perforations 1*a* multiplied by an integer. As a result, when the leading edge of the strip 1 is detected by the photoelectric sensor 14 and the strip is brought to a halt, one of the series of perforations 1*a* is indexed with the guide rollers 4. Since the guide rollers 4 are located in a position above the strip inlet of the transporting device 8 and the strip supply port of the strip container 2 as described hereinabove, the strip 1 is bent at the particular series of perforations 1*a*. Thus the bent portion of the strip 1 is located in the vicinity of a bend in the form aligner guide 3. The form aligner wedge 5 is of the wedge shape and performs the function of a member for correcting the displacements of the upper and lower forms relative to one another.

FIGS. 3 to 5 are views in explanation of the principle of the form aligning device 6 which handles the strip of continuous forms arranged in superposed relation in a plurality of layers. FIG. 3 shows the essential portions of the form aligning device 6 as seen from the side of the strip container 2. FIG. 4 is a sectional view taken along the line IV—IV in FIG. 3 showing the strip 1 before displacements of the upper and lower forms are corrected, and FIG. 5 is a view similar to FIG. 4 but shows the strip 1 after displacements of the upper and lower forms are corrected.

For the convenience of description, the strip 1 will be described as including, as shown in FIG. 4, an original form $1_1$ and a copy form $1_2$. The strip 1 is fed by way of the form aligning device 6 comprising, in addition to the form aligner guide 3, guide rollers 4 and form aligner wedge 5, an elliptic cam 5*a* and a rotary solenoid 5*b* (See FIG. 3) for driving the form aligner wedge 5, and transported by the drive roller 11*a* as the latter is driven by the motor 13 while the strip 1 being forced thereagainst by the pinch roller 12*a*.

The form aligner wedge 5 has an upper thin edge Q disposed below the upper end of the outer circumferential surface of each guide roller 4 and directed in the same direction as the upper end of the outer circumferential surface of each guide roller 4. The form aligner wedge 5 is operative to move in an upwardly directed movement in which the upper sharp edge Q of the wedge 5 moves toward a bend P of the form aligner guide 3 and a downwardly directed movement in which the wedge 5 is restored to its original position. This cycle of movements is performed as the elliptic cam 5*a*, which is in contact with the lower end of the form aligner wedge 5 and secured to a shaft 5*c* of the rotary solenoid 5*b* secured to a side wall, is actuated.

Energization of the rotary solenoid 5*b* rotates the shaft 5*c* of the solenoid 5*b* through 90 degrees to thereby move upwardly the form aligner wedge 5 in contact with the elliptic cam 5*a* at the bottom. The form aligner wedge 5 is given latitude in a vertical direction alone by a flat shaft 4*a*, so that it moves upwardly as its bottom is pushed upwardly by the elliptic cam 5*a*. Deenergization of the rotary solenoid 5*b* allows the elliptic cam 5*a* to be restored to its original position by the weight of the form aligner wedge 5 which rotates the cam 5*a* in the reverse direction, thereby restoring the form aligner wedge 5 to its original position. The shaft 4*a* supports the guide rollers 4 in a manner to allow the latter to rotate freely, and portions of the shaft 4*a* that support the respective guide rollers 4 are circular in cross section.

The strip 1 is fed and stops so that the series of perforations $1_{a1}$ and $1_{a2}$ disposed in superposed relation are successively indexed with the cutter 15*a*. When the strip 1 becomes stationary, the cutter 15*a* is actuated to sever the forms 1 from the strip at the series of perforations $1_{a1}$ and $1_{a2}$ disposed in superposed relation.

As described hereinabove, the strip 1 is fed by friction by the drive roller 11*a*. When the next following series of perforations 1*a* is brought into index with the cutter 15*a*, the upper and lower forms or the original form $1_1$ and the copy form $1_2$ might be displaced from each other by an amount $\delta$. If the strip 1 is fed without correcting the displacement, the displacement would grow in amount and cause printing to be done in wrong places on the original form $1_1$ and the copy form $1_2$ and cutting of the strip 1 to be effected in wrong places.

The present invention provides means for correcting such displacement of the upper and lower forms relative to one another.

When the strip 1 stops and one series of perforations 1*a* is indexed with the cutter 15*a*, the next following series of perforations 1*a* or the series of perforations 1*a* spaced apart from the series of perforations 1*a* indexed with the cutter 15*a* by a distance corresponding to the spacing between the two adjacent series of perforations 1*a* multiplied by an integer is disposed in the vicinity of the bend P of the form aligner guide 3.

To correct the displacement $\delta$ of the upper and lower forms relative to each other, the pinch roller 12*a* is released from pressing engagement with the drive roller 11*a* as shown in FIG. 5, to permit the form aligner wedge 5 to move in the direction of an arrow F. The form aligner wedge 5 has a vertical angle $\theta_w$ at its upper thin edge Q which substantially matches an inner angle $\theta_F$ of the bend P of the form aligner guide 3 and $\theta_w = \theta_F$. The upper thin edge Q of the form aligner wedge 5 is in spaced juxtaposed relation to the bend P of the form aligner guide 3. By moving the form aligner wedge 5 upwardly to bring the upper thin edge Q into contact with the bend P of the form aligner guide 3, the displacement $\delta$ of the original form $1_1$ and the copy form $1_2$ relative to each other can be corrected, and the two series of perforations $1_{a1}$ and $1_{a2}$ are brought into alignment with each other.

The displacement correcting operation will be described in detail.

A bent portion is formed in the strip 1 in a position above the guide rollers 4 and below the bend P of the form aligner guide 3. It often happens that after the first assembly of forms $1_1$ and $1_2$ is cut and severed from the strip 1, the bent portion of the strip is not indexed with either both or one of the two series of perforations $1_{a1}$ and $1_{a2}$ disposed in superposed relation in a plurality of layers.

Energization of the rotary solenoid 5*b* causes the form aligner wedge 5 to move in an upwardly directed movement from its original position shown in FIG. 4. When the bent portion of the strip 1 is not indexed with both of the two series of perforations $1_{a1}$ and $1_{a2}$, the upper thin edge Q of the form aligner wedge 5 moving upwardly comes into contact with the bent portion of the strip 1 ($1_1$ and $1_2$) and moves the bent portion upwardly. The strip 1 including the upper layer $1_1$ and the lower layer $1_2$ moves to the right side in the case of FIG. 4 as the bent portion is moved upwardly by the form aligner wedge 5. This moves the series of perforations $1_{a2}$ to the right side with some displacement. Further upward movement of the form aligner wedge 5 first brings the series of perforations $1_{a2}$ of the lower layer $1_2$ of the strip 1 into index with the upper thin edge Q of the form aligner wedge 5 and then brings the series of perforations $1_{a1}$ of the upper layer $1_1$ of the strip 1 into alignment with the series of perforations $1_{a2}$. As a result, the upper layer $1_1$ and the lower layer $1_2$ of the strip 1 are brought into alignment with each other.

The form aligner guide 3 performs an ancillary function in such a manner that the upper and lower layers $1_1$ and $1_2$ of the strip 1 are brought into alignment with each other at the perforations by the short stroke movement of the form aligner wedge 5. The form aligner guide 3 may be dispensed with if the stroke of the movement of the form aligner wedge 5 is somewhat increased.

In the embodiment shown and described hereinabove, the top or vertical angle $\theta_w$ of the form aligner wedge 5 is shown as being an obtuse angle. However, if it is desired to effect form alignment in a short period of time by reducing the stroke of movement of the form aligner wedge 5, the vertical angle $\theta_w$ preferably is an acute angle. About 90 degrees will be preferable because if the angle is too acute the strip might be cut at the perforations by the form aligning device 6.

Figure 6:
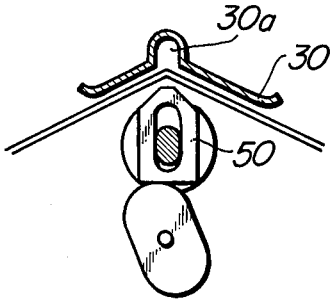
FIG. 6 is a fragmentary schematic view of a modification of the form aligning device.

If the stroke of the upwardly directed movement of the form aligner wedge 5 is increased, the strip 1 might be cut at the series of perforations indexed with the bent portion of the strip. To obviate this defect, a relief 30*a* may be formed in the bend of the form aligner guide 30 and the upper sharp edge of the form aligner wedge 50 may be a flat surface in place of the sharp edge, as shown in FIG. 6.

As soon as the upper layer $1_1$ and the lower layer $1_2$ of the strip 1 are brought into alignment with each other or the form aligner wedge 5 has moved upwardly a predetermined distance, the pinch roller 12*a* moves downwardly to press the strip 1 against the drive roller 11*a*. As a result, the strip 1 is held between the pinch roller 12*a* and the drive roller 11*a* while the upper layer $1_1$ and the lower layer $1_2$ are maintained in alignment with each other.

Thereafter, the rotary solenoid 5*b* is deenergized, allowing the form aligner wedge 5 to move downwardly to its original position shown in FIG. 4.

In the embodiment shown and described hereinabove, the pinch roller 12*a* is moved toward the drive roller 11*a* to press the strip 1 against the drive roller 11*a* as soon as the upward movement of the form aligner wedge 5 brings the upper layer $1_1$ and the lower layer $1_2$ of the strip 1 into alignment with each other. This is because when the strip 1 has resilience there might be the possibilities of the upper layer $1_1$ and the lower layer $1_2$ being displaced relative to each other again if the form aligner wedge 5 were merely restored to its original position without causing the pinch roller 12*a* to press the strip 1 against the drive roller 11*a*.

Even if the pinch roller 12*a* were not moved toward the drive roller 11*a* as soon as the upper layer $1_1$ and the lower layer $1_2$ are brought into alignment with each other, the displacement of the upper layer $1_1$ and the lower layer $1_2$ relative to each other can be substantially corrected by the vertical movement of the form aligner wedge 5 alone, and the amount of displacement can be greatly reduced from the value $\delta$ obtained before correction of the displacement is effected.

Thus when the upper layer $1_1$ and the lower layer $1_2$ of the strip 1 have no resilience or when the upper layer $1_1$ has resilience but the lower layer $1_2$ has little or no resilience, it is not essential to move the pinch roller 12 toward the drive roller 11*a*.

The need to move the pinch roller 12*a* toward the drive roller 11*a* is eliminated by the fact that since the displacement is corrected each time an assembly of forms constituting the upper and lower layer of the strip is severed from the strip, the amount of displacement can be kept below a certain level no matter how much the strip is fed to sever the assemblies of forms.

The generation of the next strip feeding signal causes the clutch 13*a* to be operated to actuate the drive rollers 11*a* and 11*b*, to thereby transport the strip 1 past the cutter assembly 15 so that the leading edge of the strip 1 is brought to a position in which the photoelectric sensor 14 is located.

In the embodiment shown and described hereinabove, the form aligner wedge 5 is wedge-shaped at its upper end portion. However, it is to be understood that the invention is not limited to this specific form of the form aligner 5 and that any member may be used in place of the form aligner wedge 5 so long as such member is capable of contacting each series of perforations 1*a* at its upper end or at its periphery as shown in FIG. 6 and bringing the upper layer $1_1$ and the lower layer $1_2$ of the strip 1 into alignment with each other. For example, such member may be a linear member. Also, in the embodiment, the bent portion of the strip 1 has been described as being disposed above the strip container 2 and the transporting device 8. However, when guide rollers are mounted on opposite sides of the strip container 2 and the transporting device 8 and arranged in such a manner that the strip 1 is formed with a depressed portion therein, the guide rollers 4 can be dispensed with because a bent portion is formed by the strip 1 by virtue of the aforesaid arrangement. When this is the case, the bent portion is concaved, and displacements of the upper and lower layers of the strip relative to one another can be corrected by the downwardly directed movement of the form aligner wedge 5.

From the foregoing description, it will be appreciated that the present invention provides an apparatus for feeding a strip of continuous forms including forms arranged in a plurality of layers, which is capable of feeding the strip without producing any displacement of the upper and lower layers relative to each other, without the use of adhesive, such as paste, for connecting the upper and lower layers together, and without the use of any particular feeding device, such as sprocket apertures.

When the apparatus according to the present invention is used, the forms arranged in the plurality of layers in the strip can be readily separated from each other for use because no paste or other adhesive is used to connect them together. Thus the risks of damaging the forms when attempts are made to separate them are not involved.

As aforesaid, the strip has no sprocket apertures in the marginal portions for feeding the strip when the apparatus according to the present invention is used. This eliminates the operation of cutting off the marginal portions of the forms severed from the strip when the forms are printed and used as tickets, for example.

It is to be understood that the present invention is not limited to the strip feeding device which does not use means, such as pasting, for connecting the upper and lower layers of a strip including forms arranged in a plurality of layers, and that any appropriate connecting means of minor degree may be used. Also, the present invention is not limited to the described order in which severing of an assembly of forms from the strip and correcting of displacements of the upper and lower layers of the strip relative to each other are practiced.

Also, the present invention is not limited to the aforesaid correction of displacements of the upper and lower layers of the strip which is practiced each time the bent portion of the strip is indexed with each series of perforations in the strip.

What is claimed is:

1. An apparatus for feeding a strip of continuous forms including forms arranged in at least two layers and having a plurality of series of perforations extending widthwise of the strip and arranged at regular intervals lengthwise of the strip, comprising:

a. a guide formed with a bend for forming a bent portion in said strip in a position corresponding to one of said plurality of series of perforations;

b. a member located inwardly of the bent portion of said strip; and c. drive means for moving at least one of said guide and said member relative to the other to bring the bent portion of the strip into contact with the member.

2. An apparatus as claimed in claim 1, wherein said member is wedge-shaped.

3. An apparatus as claimed in claim 1 or 2, wherein said bend of said guide is formed with a relief.

4. An apparatus as claimed in claim 2, wherein the tip of said wedge-shaped member is a flat surface.

5. An apparatus as claimed in claim 1 or 2, wherein said drive means includes a cam engageable with said member to move the latter toward and away from said guide.

* * * * *